United States Patent [19]

MacNeil

[11] 4,454,664

[45] Jun. 19, 1984

[54] ADJUSTABLE-LENGTH, COMBINED GOLF SPIKE RECEPTACLES AND RECEPTACLE ANCHORING DEVICES

[76] Inventor: Arden B. MacNeil, Garrison House La., Sudbury, Mass. 01776

[21] Appl. No.: 458,355

[22] Filed: Jan. 17, 1983

[51] Int. Cl.[3] ..... A43B 5/00

[52] U.S. Cl. ..... 36/127; 36/114; 36/134; 36/67 A; 36/67 D; 36/66

[58] Field of Search ..... 36/127, 114, 134, 67 A, 36/67 D, 66, 67 B

[56] References Cited

U.S. PATENT DOCUMENTS

| | | | |
|---|---|---|---|
| 3,343,284 | 3/1965 | MacNeill | 36/66 |
| 3,410,055 | 4/1965 | Szerenyi | 36/127 |
| 3,866,339 | 2/1975 | Latto | 36/127 |
| 4,063,372 | 12/1977 | MacNeill | 36/127 |
| 4,178,702 | 2/1979 | Mayer | 36/127 |

FOREIGN PATENT DOCUMENTS

| | | | |
|---|---|---|---|
| 774742 | 5/1957 | United Kingdom | 36/67.5 |

*Primary Examiner*—Werner H. Schroeder
*Assistant Examiner*—Mary A. Ellis

[57] ABSTRACT

Adjustable-length, golf spike receptacles and anchoring strip combinations for use in soles of various sizes and widths comprise (1) an elongated strip of thin, flexible material and (2) a pair of golf spike receptacles which are attached, one at each end to the elongated strip. The golf spike receptacles comprise (a) an internally threaded sleeve or cylinder for receiving the threads of a golf spike and (b) a base plate to which the sleeve is attached at about a right angle to its axis. The base plates of the golf spike receptacles are attached to the ends of the elongated strips by attaching means in a manner such that at least one plate and preferably both plates are rotatable about the attaching means. In a further embodiment one or both the attaching means are slidably movable in elongated channels provided adjacent to the ends of the anchoring strip.

6 Claims, 4 Drawing Figures

ADJUSTABLE-LENGTH, COMBINED GOLF SPIKE RECEPTACLES AND RECEPTACLE ANCHORING DEVICES

BRIEF SUMMARY OF INVENTION

The invention relates to devices for fastening golf spikes to the soles of shoes and more particularly to combined golf spike receptacles and receptacle anchoring strips in which the distance between the receptacles may be adjustably varied to accommodate the different widths encountered at various locations along the sole and with soles of different sizes.

BACKGROUND OF INVENTION AND PRIOR ART

Receptacles for golf spikes in golf shoes are subjected to considerable stresses during use. In my U.S. Pat. No. 3,343,284 combined golf spike receptacles and receptacle anchoring strips are disclosed which help offset and absorb such stresses. Generally, the devices disclosed therein comprise the combination of (a) an elongated, thin, flat anchor strip of flexible material such as spring steel and (b) a pair of internally threaded golf spike receptacles which are attached, one at each end, to the anchoring strip. The attachment of the receptacles to the strip is accomplished by providing in the side walls of the strip, adjacent each end, a pair of opposed notches and by providing the golf spike receptacles at their bases with a pair of opposed fingers which are bent around the notches. In said patent it was recognized that there existed a cumbersome inventory problem to provide devices to accommodate the different widths encountered. To fill such need an embodiment was disclosed wherein the length between the golf spike receptacles could be made adjustable by elongating the notches and having the bent-over fingers be slidably movable along the length of the notches. Although the devices disclosed in my patent function quite satisfactorily, it should be clear that their manufacture involves a considerable number of steps.

OBJECTS AND SUMMARY OF INVENTION

One object of the present invention is to provide adjustable-length, combined golf spike receptacles and receptacle anchoring strip devices which are more versatile and functionally simple to adjust.

Another object is to provide devices of this nature which readily lend themselves to mass production and cut down the number of manufacturing steps involved.

These and other objects are achieved by providing devices generally comprising an elongated anchor strip of thin flexible material in combination with a pair of golf spike receptacles in the form of an internally threaded sleeve having two ends and an axis centrally of the threaded sleeve, one of the sleeve ends being joined to a base plate, the plane of which plate is substantially at right angles to the axis of the sleeve, the plates being attached adjacent to the ends of the strip by attaching means; the mode of attachment being such that at least one and preferably both plates are rotatable about the attaching means so that the distance between receptacles can be adjusted by rotating one or both plates relative to one another.

In a further embodiment of the invention, elongated slots are provided at one or both ends of the anchoring strip for receiving the attaching means in a manner such that the attaching means is slidably movable in said slot or slots; thus providing a further mode of adjusting the distance between receptacles.

DETAILED DESCRIPTION

Figure 1:
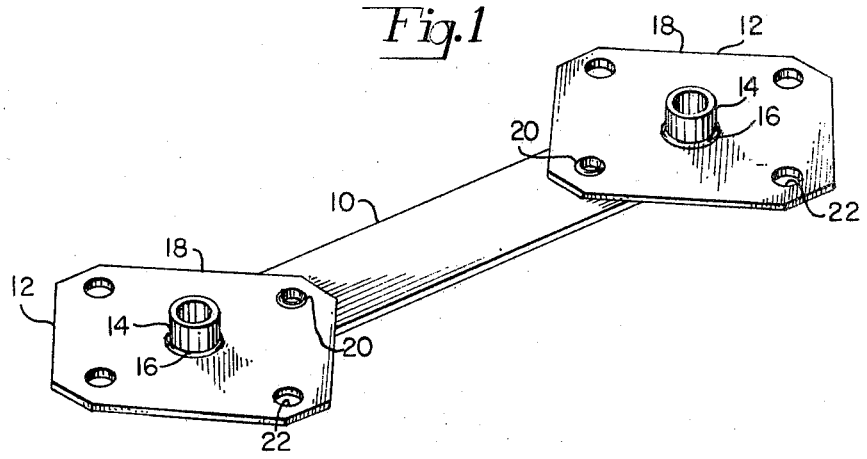
FIG. 1 is a bottom view of a device of the invention.
Figure 2:
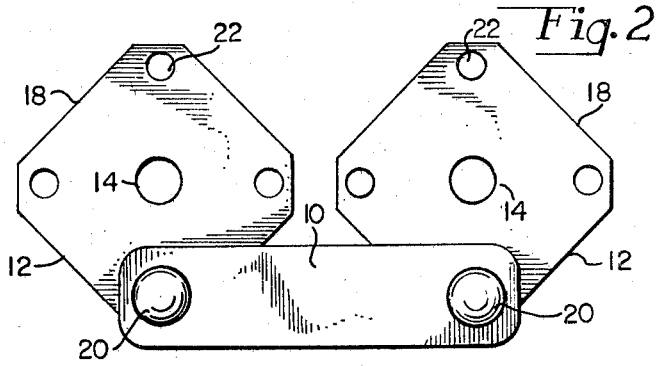
FIG. 2 is a top view of the device of FIG. 1.

Referring to FIGS. 1 and 2 of the drawings there is shown a device within the scope of the invention comprising the combination of a thin, flat, elongated anchoring strip 10 and a pair of golf spike receptacles 12. Although not critical the anchoring strip 10 is preferably in the order of about 0.02 inches in thickness and is formed from a flexible material such as carbon or stainless spring steel.

The golf spike receptacles 12 comprise an internally threaded sleeve or cylinder 14 having a centrally located axis. The upper end of the sleeve 14 is joined through a flared portion 16 to a base plate 18, the plane of which (base plate 18) is about perpendicular to the axis of the sleeve 14. The base plates 18 are provided with a plurality of ports or openings 22 which accommodate the flow and retention of molding material when the devices of this invention are used in sole manufacturing processes wherein they are molded directly into the soles.

A base plate 18 is attached adjacent to each end of the anchoring strip 10 by attaching means such as rivets 20. The rivets 20 are inserted in a manner such that at least one base plate 18 and preferably each base plate 18 is rotatable about its point of attachment, i.e., about the rivet 20 which joins it to the strip 10.

Figure 4:
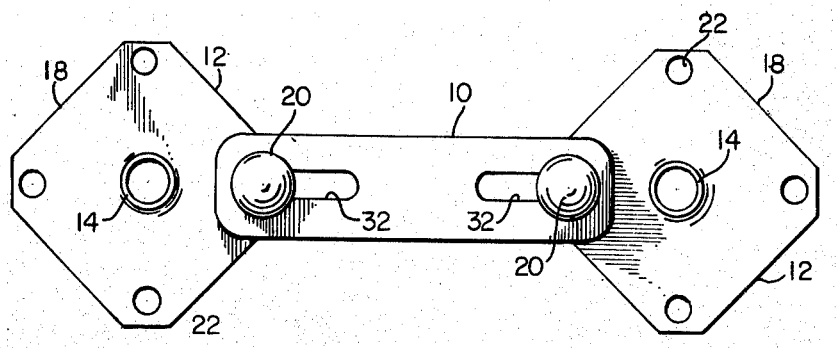
FIG. 4 is a top view of another embodiment of a device within the scope of the invention.

Referring to FIG. 4, there is shown a further embodiment of the invention which provides a further mode of varying the distance between the sleeves 14. In such embodiment there is provided at each end of the anchoring strip 10 an elongated slot or channel 32 which is aligned about parallel to the length of said strip 10. The slots or channels 32 are adapted to receive the attaching means, i.e., the rivets 20 in a manner such that said attaching means 20 are reciprocally moveable along the length of said slots or channels 32; thus providing a further means for variably adjusting the distance between sleeves 14.

It should be clear that the lengths of the anchoring strips 10 and channels 32, the dimensions of the base plates 18 and the precise points at which the plates 18 are attached to the strips 10 may be varied to suit particular needs. Generally, they will be such that by a simple rotation of one or both of the base plates 18 and/or slidably moving one or both attaching means (rivets) 20 in the channels 32, the distance between the sleeves 14 may be adjusted to encompass all the widths encountered at various locations along the length of the soles and in soles of different sizes. In FIGS. 1 and 4 the plates 18 are shown in the position which would provide the longest length and in FIG. 2 the plates 18 are shown in a position which would accommodate an intermediate length. Although not shown, the shortest length would be provided for by rotating the plates (18)

180° from the position shown in FIG. 4 and moving the attaching means 20 in channels 32 toward one another.

Figure 3:
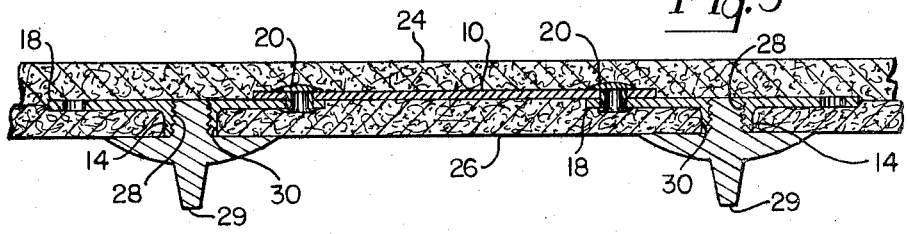
FIG. 3 is a cross-sectional view of the device of FIGS. 1 and 2 between portions of inner and outer soles and carrying a pair of golf spikes.

Referring to FIG. 3, the use of the devices within the present invention is demonstrated in an embodiment wherein it is inserted between layers of the sole. As shown, the device of FIGS. 1 and 2 is positioned between the inner sole 24 and the outer sole 26. Prior to its positioning the base plates 18 were rotated relative to one another until the sleeves 14 were the proper distance apart to permit their insertion into the opening 30 of outer sole 26. Upon insertion, spikes 29 were attached by threading posts 28 into the internal threads of the sleeves 14. It will be understood that the device shown in FIG. 4 can be used in a similar manner except that movement of the rivets 20 in slots 32 can be used to further adjust the distance between the sleeves 14.

Although it is not shown, it will be understood that the devices of this invention may be molded directly into the soles by methods well known to those skilled in the molding art.

Having thus disclosed my invention, what is claimed is:

1. An adjustable-length golf spike receptacle and receptacle anchor strip combination for accommodating shoe soles of various sizes and widths, said combination comprising (1) an elongated strip of thin, flexible material and (2) a pair of golf spike receptacles, each receptacle comprising (a) an internally threaded sleeve with an axis centrally of said sleeve and (b) a base plate which is joined to said sleeve at about a right angle to said axis; said base plates being attached, one adjacent to each end, to the elongated strip by attaching means; at least one of said base plates being attached so as to be rotatable about the attaching means whereby through the rotation of said plate the distance between the sleeves may be varied.

2. A combination as defined in claim 1 wherein both of said base plates are attached so as to be rotatable about their attaching means.

3. A combination as defined in claim 1 wherein at least one of said attaching means is slidably moveable in an elongated slot, provided adjacent to the end of said elongated strip.

4. A combination as defined in claim 1 wherein both of said attaching means are slidably movable in elongated slots provided adjacent to each end of said elongated strip.

5. A combination as defined in claim 2 wherein at least one of said attaching means is slidably movable in an elongated slot provided adjacent to the end of said elongated strip.

6. A combination as defined in claim 2 wherein both of said attaching means are slidably movable in elongated slots provided adjacent to each end of said elongated strip.

* * * * *